US005205558A

United States Patent [19]

Wilson

[11] Patent Number: 5,205,558

[45] Date of Patent: Apr. 27, 1993

[54] SPHERICAL PUZZLE

[76] Inventor: Henry G. Wilson, 340 E. 92nd St., Brooklyn, N.Y. 11212

[21] Appl. No.: 877,998

[22] Filed: May 4, 1992

[51] Int. Cl.[5] ..... A63F 9/08; A63F 7/04

[52] U.S. Cl. ..... 273/153 R; 273/113

[58] Field of Search ..... 273/153 R, 153 S, 156, 273/441-444, 113, 115

[56] References Cited

U.S. PATENT DOCUMENTS

| | | | |
|---|---|---|---|
| 3,423,872 | 1/1969 | Dodson | 273/113 |
| 3,785,651 | 1/1974 | Smith | 273/153 R |
| 3,827,694 | 8/1974 | Lemelson | 273/113 |
| 4,251,075 | 2/1981 | Jaworski et al. | 273/113 |
| 4,550,912 | 11/1985 | Allen | 273/113 |
| 4,805,910 | 2/1989 | Monticolombi et al. | 273/153 R |
| 4,822,047 | 4/1989 | Treer | 273/153 R |
| 4,989,872 | 2/1991 | Urrestarazu Borda | 273/153 R |

FOREIGN PATENT DOCUMENTS

| | | | |
|---|---|---|---|
| 2589076 | 4/1987 | France | 273/113 |
| 2177012 | 1/1987 | United Kingdom | 273/153 S |
| 8400307 | 2/1984 | World Int. Prop. O. | 273/113 |

*Primary Examiner*—V. Millin
*Assistant Examiner*—Steven B. Wong
*Attorney, Agent, or Firm*—Leon Gilden

[57] ABSTRACT

A spherical puzzle has an internal spherical cavity having a plurality of maze sections interconnected, with an exit opening of an upper maze section spaced at an opposed end of a circuitous path of an underlying maze section. The polar ends of the maze section with the maze sections coaxially aligned relative to the North and South polar portions of the maze have transparent caps for viewing an entrance and exit of a game sphere directed through the sections.

3 Claims, 4 Drawing Sheets

SPHERICAL PUZZLE

BACKGROUND OF THE INVENTION

1. Field of the Invention

The field of invention relates to puzzle structure, and more particularly pertains to a new and improved spherical puzzle wherein the same is directed to the entertainment and amusement of individuals by directing a sphere through a plurality of stacked sections.

2. Description of the Prior Art

Puzzles of various types have been utilized throughout the prior art for the entertainment and amusement of individuals, wherein the instant invention sets forth a puzzle structure directed to require patience as well as manual coordination to direct a spherical game sphere through the puzzle. Examples of various puzzle structure is set forth in the U.S. Pat. Nos. 3,787,054; 4,413,823; 3,749,405; 3,790,175; and 4,822,049.

The prior art has heretofore failed to set forth the unique inter-relationship of the organization as set forth in the instant invention addressing both the problems of ease of use as well as effectiveness in construction and in this respect, the present invention substantially fulfills this need.

SUMMARY OF THE INVENTION

In view of the foregoing disadvantages inherent in the known types of puzzle structure now present in the prior art, the present invention provides a spherical puzzle wherein the same is directed to the guidance of a game sphere through a spherical puzzle without benefit of visual appreciation as to the positioning of the sphere within the various puzzle sections due to the opaque outer spherical shell. As such, the general purpose of the present invention, which will be described subsequently in greater detail, is to provide a new and improved spherical puzzle which has all the advantages of the prior art puzzle apparatus and none of the disadvantages.

To attain this, the present invention provides a spherical puzzle with an internal spherical cavity having a plurality of maze sections interconnected, with an exit opening of an upper maze section spaced at an opposed end of a circuitous path of an underlying maze section. The polar ends of the maze section with the maze sections coaxially aligned relative to the North and South polar portions of the maze have transparent caps for viewing of an entrance and exit of a game sphere directed through the sections.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spherical puzzle which has all the advantages of the prior art puzzle apparatus and none of the disadvantages.

It is another object of the present invention to provide a new and improved spherical puzzle which may be easily and efficiently manufactured and marketed.

It is a further object of the present invention to provide a new and improved spherical puzzle which is of a durable and reliable construction.

An even further object of the present invention is to provide a new and improved spherical puzzle which is susceptible of a low cost of manufacture with regard to both materials and labor, and which accordingly is then susceptible of low prices of sale to the consuming public, thereby making such spherical puzzles economically available to the buying public.

Still yet another object of the present invention is to provide a new and improved spherical puzzle which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
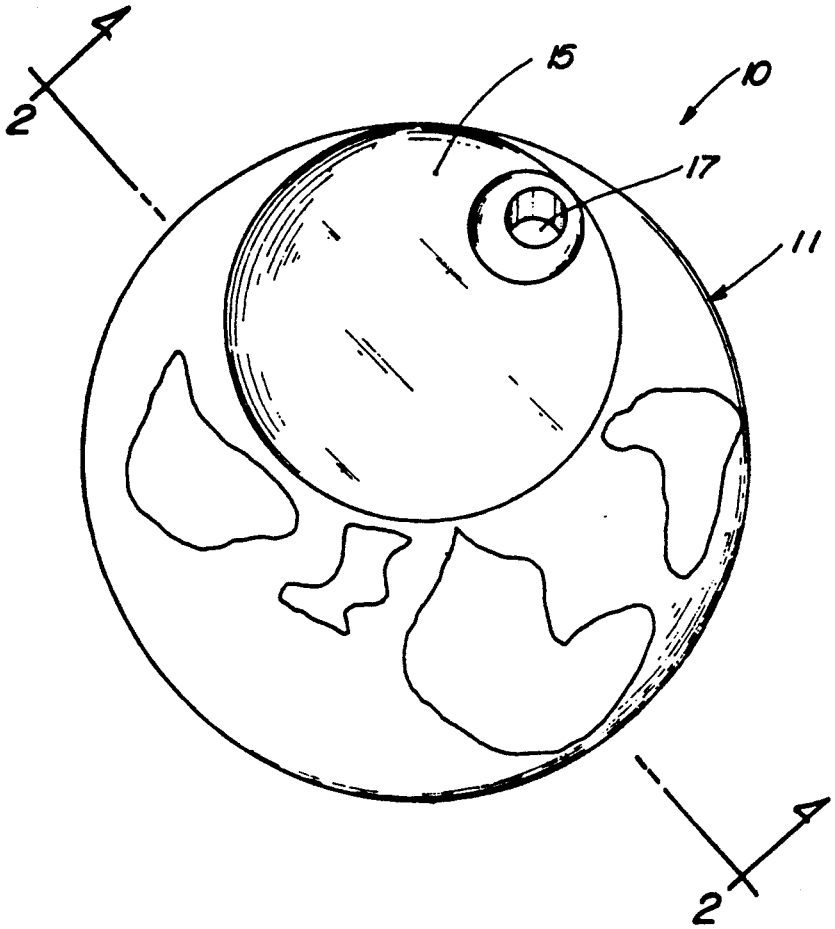
FIG. 1 is an isometric illustration of the instant invention.

With reference now to the drawings, and in particular to FIGS. 1 to 11 thereof, a new and improved spherical puzzle embodying the principles and concepts of the present invention and generally designated by the reference numeral 10 will be described.

Figure 2:
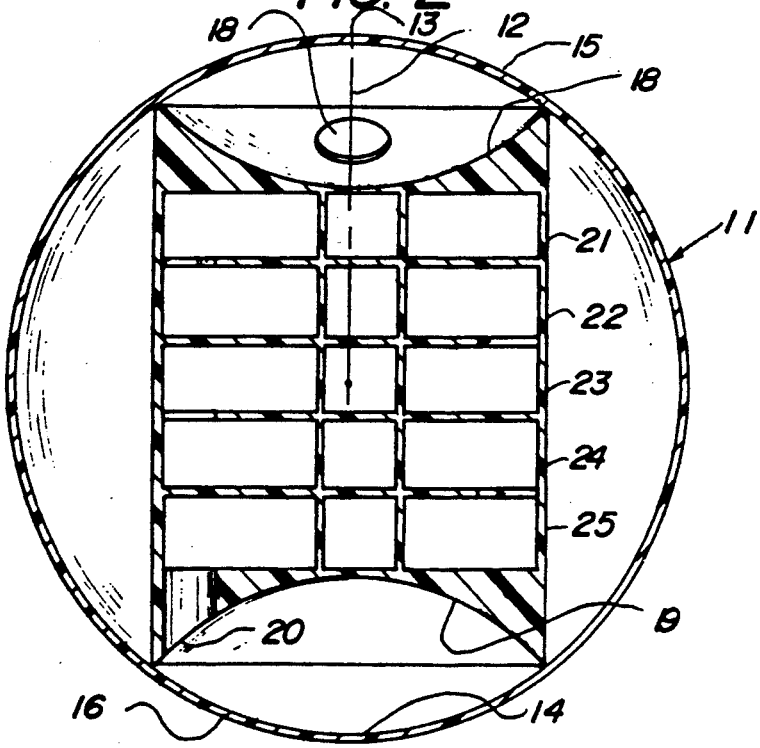
FIG. 2 is an orthographic view, taken along the lines 2—2 of FIG. 1 in the direction indicated by the arrows.
Figure 3:
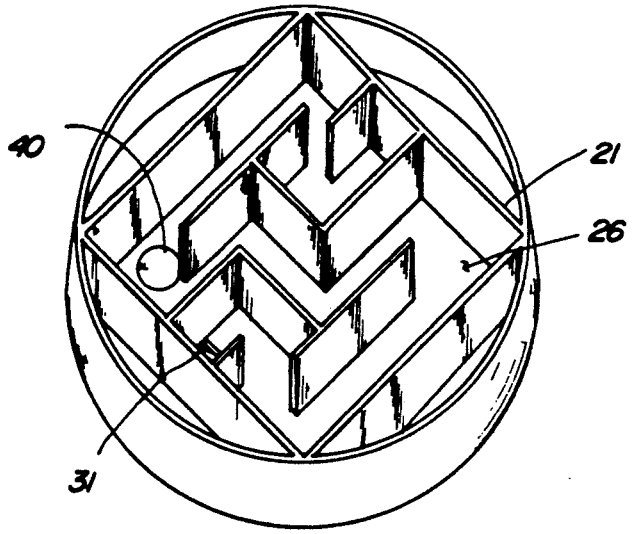
FIG. 3 is an isometric illustration of the first maze section.
Figure 4:
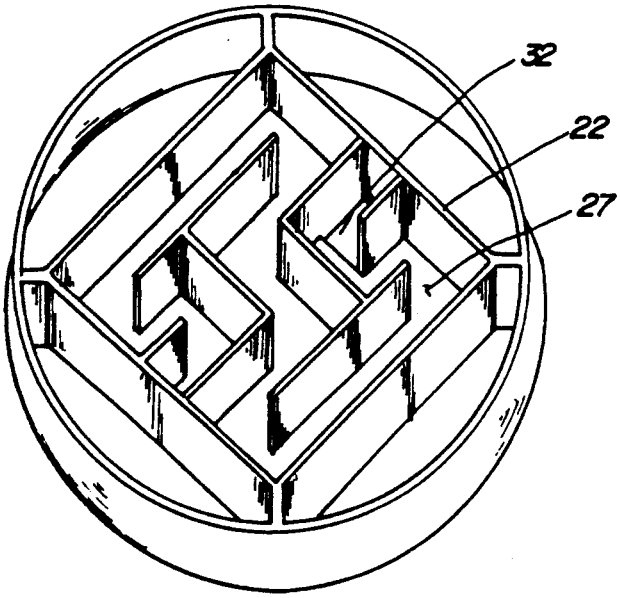
FIG. 4 is an isometric illustration of the second maze section.
Figure 5:
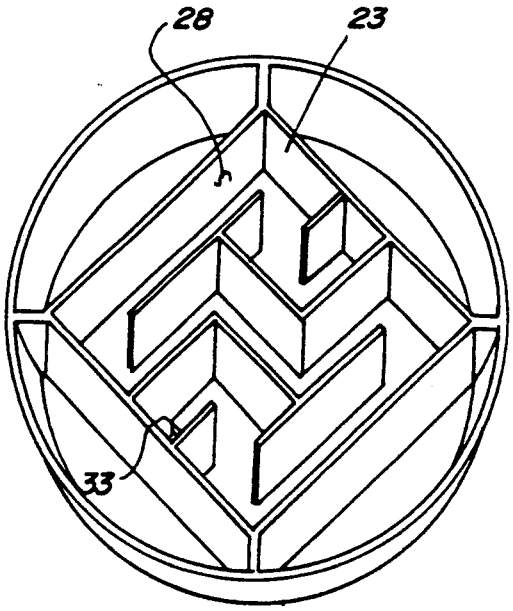
FIG. 5 is an isometric illustration of the third maze section.
Figure 6:
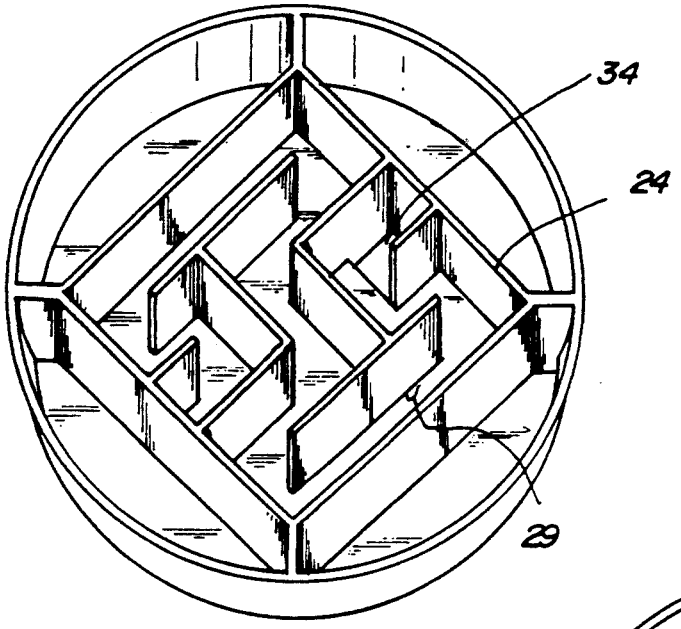
FIG. 6 is an isometric illustration of the fourth maze section.
Figure 7:
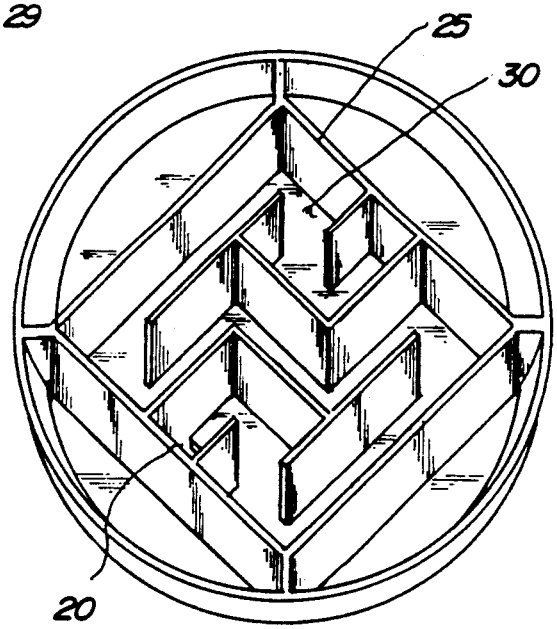
FIG. 7 is an isometric illustration of the fifth maze section.
Figure 8:
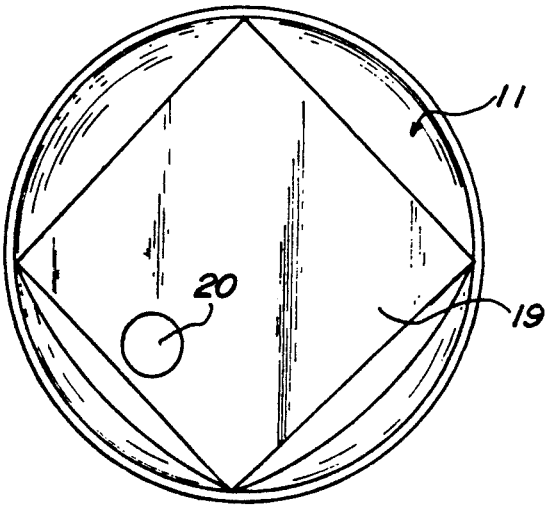
FIG. 8 is an orthographic view of the Southern polar cap support trough.

More specifically, the spherical puzzle 10 of the instant invention essentially comprises a rigid spherical shell 11 typically provided with an outer shell of a world geographic simulation. An axis 12 is defined by the shell 11, with a North pole 13 and a South pole 14 depicted by the respective North and South intersection of the axis 12 with the outer spherical shell 11. Transparent North and South semi-spherical windows 15 and 16 are positioned at the North and South polar portions in surrounding relationship relative to the North and South poles, with each window medially intersected by the axis 12. A North window entrance opening 17 is directed through the North window 15 positioned above a Northern cap concave support trough 18 below the Northern window. A South cap concave support trough 19 is positioned below the Southern window within the shell 11, with a North cap support trough exit opening 18*a* directed through the Northern cap trough 18 for access to the maze sections 21–25 oriented between the North and South troughs 18 and 19. The transparent North and South window members 15 and 16 permit visual access to the entrance and exit of an associated metallic game sphere 40 (see FIG. 3) during its entrance and exit into the first through fifth maze sections 21–25 respectively. Accordingly, a South support trough exit opening 20 is directed from the fifth maze section 25 into the spacing between the South cap concave trough 19 and the South transparent window 16, as illustrated in FIG. 2. The first through fifth maze sections 21–25 are arranged in a parallel relationship coaxially aligned relative to the axis 12, with each maze section having a respective floor orthogonal relative to the axis 12. The first through fifth maze sections 21–25 have first through fifth circuitous maze section paths 26–29 inclusively directed through the maze sections. The North window entrance opening 17 is positioned substantially medially over the first path 26, with the first path exit opening 31 directed at a first end of the second path 27. The second path exit opening 32 is positioned at an opposite end of the second path 27 and a first end of the third path 28. Similarly, the third path exit opening 33 is positioned at opposite ends of the third path 28 spaced from the first end of the path 28, with the third exit opening 33 directed at a first end of a fourth path 29. A fourth path exit opening 34 is directed at an opposed end of the fourth path 29 to the floor of that maze onto first end of the fifth path 30, with fifth path 30 having the South cap exit opening 20 directed onto the South cap.

Patience, perseverance, and manual dexterity must be utilized in directing of the game sphere 40 throughout the mazes of the invention to direct the game sphere from the North window entrance opening 17 onto the South cap support trough 19.

Figure 9:
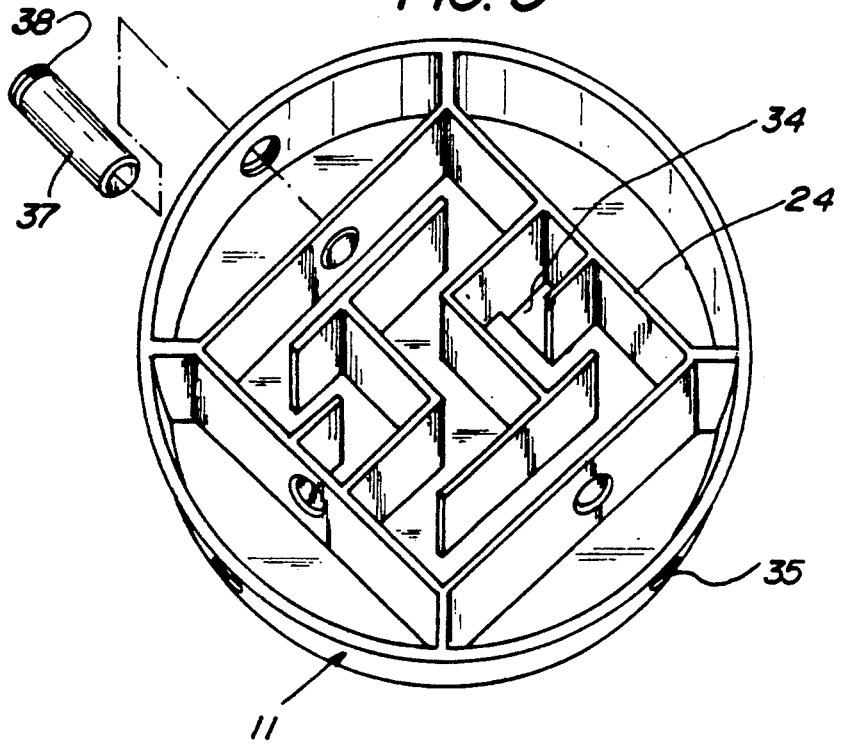
FIG. 9 is an isometric illustration of a modified maze section for use by the invention.
Figure 10:
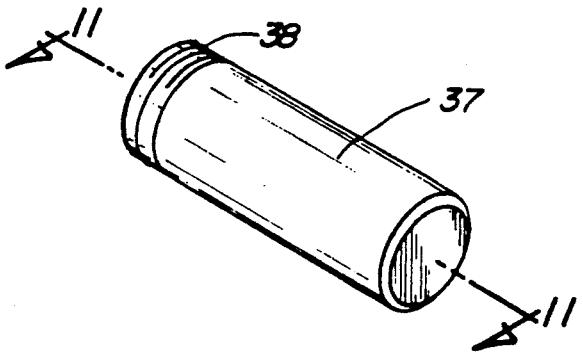
FIG. 10 is an isometric illustration of the cylindrical magnet utilized by the invention, as set forth in FIG. 9.
Figure 11:
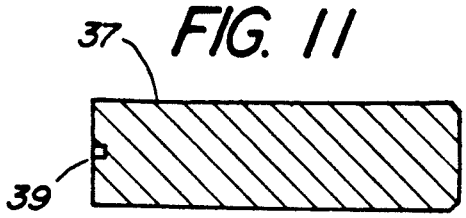
FIG. 11 is an orthographic view, taken along the lines 11—11 of FIG. 10 in the direction indicated by the arrows.

The FIGS. 9–11 illustrate the use of a cylindrical magnet 37 having a forward end wall spaced from a rear end wall, with the forward end wall received within the maze wall cylindrical recess 36 that is coaxially aligned with a threaded shell bore 35 directed through the spherical shell 11. A threaded shell bore 35 is spaced from the maze wall cylindrical recess 36 a predetermined length substantially equal to the predetermined length of the cylindrical magnet 37 between the forward end wall and the rear end wall. The rear end wall has adjacent thereto a threaded portion 38 threadedly directed into the threaded shell bore 35, with a screw driver slot 39 directed into the rear end wall to enhance ease of installation of the cylindrical magnet 37. In this manner, magnetic attraction to the metallic game sphere 40 typically formed of a ferrous material is effected thereby adding a degree of difficulty if required in play of the game. Accordingly, a plurality of such threaded shell bores 35 and associated maze recesses may be directed throughout the game sphere, wherein the fourth maze section 24 is utilized by way of example and such construction may be duplicated throughout the maze sections.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A spherical puzzle, wherein the puzzle comprises, a rigid spherical shell having a spherical cavity therewithin defined along an axis, the axis having opposed ends which intersect the shell at a North pole and a South pole, and a transparent North window medially intersected by the axis at the North pole, and a Southern semi-spherical window directed through the shell and medially intersected by the axis at the South pole, and a North window entrance directed through the North window, with a North cap concave support trough positioned below the North window, with the North concave support trough having a North support trough exit opening directed therethrough, and a plurality of maze sections coaxially aligned along the axis, with each maze section having a maze floor orthogonally oriented relative to the axis, and each maze floor having a respective exit opening, wherein a lowermost maze section below the North concave support trough includes a South cap exit opening in communication with a South cap support trough.

2. A puzzle as set forth in claim 1, wherein each maze section includes a circuitous maze path.

3. A puzzle as set forth in claim 2, wherein at least one of said maze sections includes a plurality of maze walls in surrounding relationship relative to the at least one maze section, and the maze walls each include a respective cylindrical recess, the spherical shell includes a plurality of internally threaded shell bores, with each shell bore coaxially aligned with a respective cylindrical wall recess and spaced apart thereto a predetermined spacing, and at least one cylindrical magnet defined by a predetermined length equal to the predetermined spacing, with the cylindrical magnet having a forward end wall spaced from a rear end wall, the forward end wall arranged for reception within one of said cylindrical recesses, and the cylindrical magnet having a threaded portion positioned about the magnet adjacent the rear end wall for reception within at least one of said threaded shell bores.

* * * * *